US006039543A

United States Patent [19]

Littleton

[11] Patent Number: 6,039,543

[45] Date of Patent: Mar. 21, 2000

[54] PUMP SHUT OFF SYSTEM

[76] Inventor: Jerry W. Littleton, 1905 W. 2nd St., Mesa, Ariz. 85201

[21] Appl. No.: 09/078,629

[22] Filed: May 14, 1998

[51] Int. Cl.[7] ..... F04B 49/02

[52] U.S. Cl. ..... 417/12; 417/43

[58] Field of Search ..... 417/12, 43, 9, 417/33

[56] References Cited

U.S. PATENT DOCUMENTS

| | | | |
|---|---|---|---|
| 3,963,375 | 6/1976 | Custis | 417/12 |
| 4,329,120 | 5/1982 | Walters | 417/43 X |
| 4,507,053 | 3/1985 | Frizzell | 417/43 X |

*Primary Examiner*—Harry B. Tanner

[57] ABSTRACT

A new pump shut off system for shutting off a pump when there is insufficient fluid to pump through the pump. The inventive device includes a pump with a primary switch for selectively activating and deactivating the pump. A processor is electrically connected to the primary switch. The processor has a timer for measuring a predetermined amount of time. The processor deactivates the pump after the timer measures the predetermined amount of time. The processor also has a flow switch with a flow sensor in an outlet conduit of the pump. The flow switch deactivates the timer to prevent the timer from measuring the predetermined amount of time when the flow switch is activated by the flow sensor when the flow sensor detects fluid flow through the outlet conduit above the predetermined amount during the predetermined amount of time.

8 Claims, 2 Drawing Sheets

PUMP SHUT OFF SYSTEM

BACKGROUND OF THE INVENTION

1. Field of the Invention

The present invention relates to systems for shutting off a pump from pumping and more particularly pertains to a new pump shut off system for shutting off a pump when there is insufficient fluid to pump through the pump.

2. Description of the Prior Art

The use of systems for shutting off a pump from pumping is known in the prior art. More specifically, systems for shutting off a pump from pumping heretofore devised and utilized are known to consist basically of familiar, expected and obvious structural configurations, notwithstanding the myriad of designs encompassed by the crowded prior art which have been developed for the fulfillment of countless objectives and requirements.

Known prior art systems for shutting off a pump from pumping include U.S. Pat. No. 5,120,198; U.S. Pat. No. 5,601,413; U.S. Pat. No. 2,917,922; U.S. Pat. No. 5,076,763; U.S. Pat. No. 4,322,297; and U.S. Pat. No. 3,453,962.

While the prior art include pumps that run on timers that turn on the pump regularly, these pumps do not detect whether there is sufficient fluid for the pump to pump. If there is insufficient fluid passing through the pump, the risk of the pump burning out is greatly increased.

While these devices fulfill their respective, particular objectives and requirements, the aforementioned patents do not disclose a new pump shut off system. The inventive device includes a pump with a primary switch for selectively activating and deactivating the pump. A processor is electrically connected to the primary switch. The processor has a timer for measuring a predetermined amount of time. The processor deactivates the pump after the timer measures the predetermined amount of time. The processor also has a flow switch with a flow sensor in an outlet conduit of the pump. The flow switch deactivates the timer to prevent the timer from measuring the predetermined amount of time when the flow switch is activated by the flow sensor when the flow sensor detects fluid flow through the outlet conduit above the predetermined amount of time during the predetermined amount of time.

In these respects, the pump shut off system according to the present invention substantially departs from the conventional concepts and designs of the prior art, and in so doing provides an apparatus primarily developed for the purpose of shutting off a pump when there is insufficient fluid to pump through the pump.

SUMMARY OF THE INVENTION

In view of the foregoing disadvantages inherent in the known types of systems for shutting off a pump from pumping now present in the prior art, the present invention provides a new pump shut off system construction wherein the same can be utilized for shutting off a pump when there is insufficient fluid to pump through the pump.

The general purpose of the present invention, which will be described subsequently in greater detail, is to provide a new pump shut off system apparatus and method which has many of the advantages of the systems for shutting off a pump from pumping mentioned heretofore and many novel features that result in a new pump shut off system which is not anticipated, rendered obvious, suggested, or even implied by any of the prior art systems for shutting off a pump from pumping, either alone or in any combination thereof.

To attain this, the present invention generally comprises a pump with a primary switch for selectively activating and deactivating the pump. A processor is electrically connected to the primary switch. The processor has a timer for measuring a predetermined amount of time. The processor deactivates the pump after the timer measures the predetermined amount of time. The processor also has a flow switch with a flow sensor in an outlet conduit of the pump. The flow switch deactivates the timer to prevent the timer from measuring the predetermined amount of time when the flow switch is activated by the flow sensor when the flow sensor detects fluid flow through the outlet conduit above the predetermined amount of time during the predetermined amount of time.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pump shut off system apparatus and method which has many of the advantages of the systems for shutting off a pump from pumping mentioned heretofore and many novel features that result in a new pump shut off system which is not anticipated, rendered obvious, suggested, or even implied by any of the prior art systems for shutting off a pump from pumping, either alone or in any combination thereof.

It is another object of the present invention to provide a new pump shut off system which may be easily and efficiently manufactured and marketed.

It is a further object of the present invention to provide a new pump shut off system which is of a durable and reliable construction.

An even further object of the present invention is to provide a new pump shut off system which is susceptible of a low cost of manufacture with regard to both materials and labor, and which accordingly is then susceptible of low prices of sale to the consuming public, thereby making such pump shut off system economically available to the buying public.

Still yet another object of the present invention is to provide a new pump shut off system which provides in the apparatuses and methods of the prior art some of the advantages thereof, while simultaneously overcoming some of the disadvantages normally associated therewith.

Still another object of the present invention is to provide a new pump shut off system for shutting off a pump when there is insufficient fluid to pump through the pump.

Yet another object of the present invention is to provide a new pump shut off system which includes a pump with a primary switch for selectively activating and deactivating the pump. A processor is electrically connected to the primary switch. The processor has a timer for measuring a predetermined amount of time. The processor deactivates the pump after the timer measures the predetermined amount of time. The processor also has a flow switch with a flow sensor in an outlet conduit of the pump. The flow switch deactivates the timer to prevent the timer from measuring the predetermined amount of time when the flow switch is activated by the flow sensor when the flow sensor detects fluid flow through the outlet conduit above the predetermined amount of time during the predetermined amount of time.

Still yet another object of the present invention is to provide a new pump shut off system that includes a sensor for detecting whether there is sufficient fluid flow from the inlet conduit to the outlet conduit through the pump such that the pump is deactivated when insufficient fluid flow is detected.

Even still another object of the present invention is to provide a new pump shut off system that prevents pool pumps from burning out when the water supply to the pool is shut off but the pool pump is still running.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
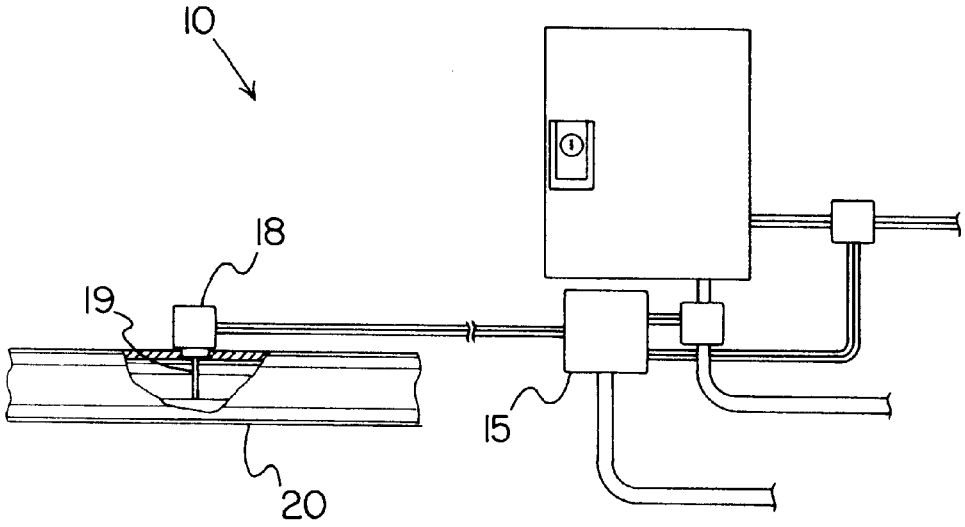
FIG. 1 is a schematic side view of a new pump shut off system according to the present invention.

With reference now to the drawings, and in particular to FIGS. 1 through 4 thereof, a new pump shut off system embodying the principles and concepts of the present invention and generally designated by the reference numeral 10 will be described.

As best illustrated in FIGS. 1 through 4, the pump shut off system 10 generally comprises a pump 12 with a primary switch 13 for selectively activating and deactivating the pump 12. A processor 15 is electrically connected to the primary switch 13. The processor 15 has a timer 16 for measuring a predetermined amount of time. The processor 15 deactivates the pump 12 after the timer 16 measures the predetermined amount of time. The processor 15 also has a flow switch 18 with a flow sensor 19 in an outlet conduit 20 of the pump 12. The flow switch 18 deactivates the timer 16 to prevent the timer 16 from measuring the predetermined amount of time when the flow switch 18 is activated by the flow sensor 19 when the flow sensor 19 detects fluid flow through the outlet conduit 20 above the predetermined amount of time during the predetermined amount of time.

In use, the shut off system 10 is designed preferably for a pool pump which pumps water into a swimming pool. In closer detail, the pump 12 has an inlet conduit and an outlet conduit 20. The pump 12 is designed for pumping fluid from the inlet conduit to the outlet conduit 20 when the pump 12 is activated. A power source 14 is electrically connected to the pump 12 to provide power to activate the pump 12. The pump 12 has a primary switch 13 for selectively activating and deactivating the pump 12. The switch is located preferably on the circuit between the pump 12 and power source 14.

The processor 15 is electrically connected to the primary switch 13 and to the pump 12 and to the power supply 14. The processor 15 has a timer 16 for measuring a predetermined amount of time. Ideally, the predetermined amount of time is between about 3 and 5 minutes. The timer 16 is activated to measure the predetermined amount of time when the primary switch 13 is actuated to activate the pump 12. The processor 15 also has a relay 17 for selectively shutting off power from the power supply to the pump 12 when the relay 17 is activated. In use, the timer 16 activates the relay 17 to shut off power from power supply to the pump 12 after the timer 16 measures the predetermined amount of time.

Figure 2:
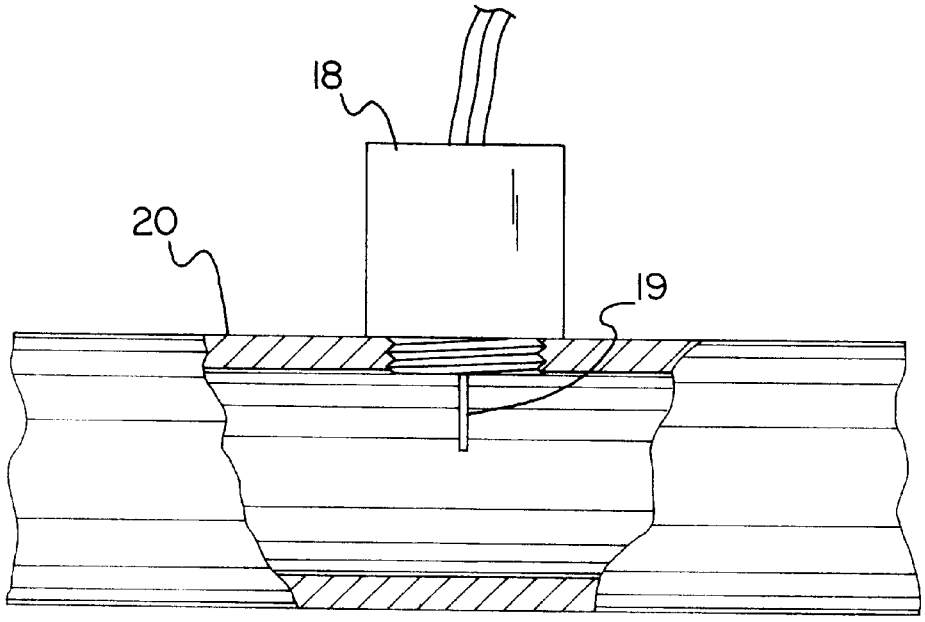
FIG. 2 is a schematic sectional view of the flow sensor and flow switch of the present invention.
Figure 3:
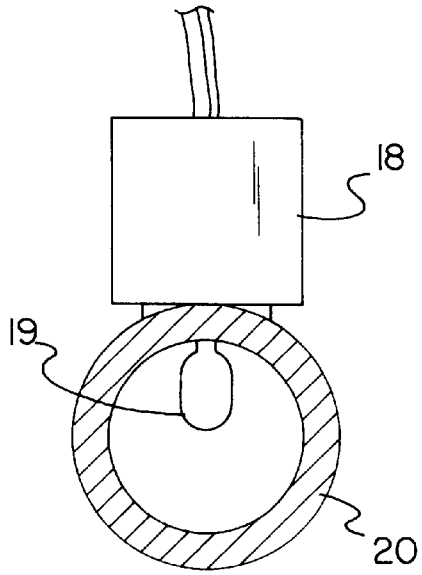
FIG. 3 is a schematic sectional view of the present invention as seen from line 3—3 on FIG. 2.
Figure 4:
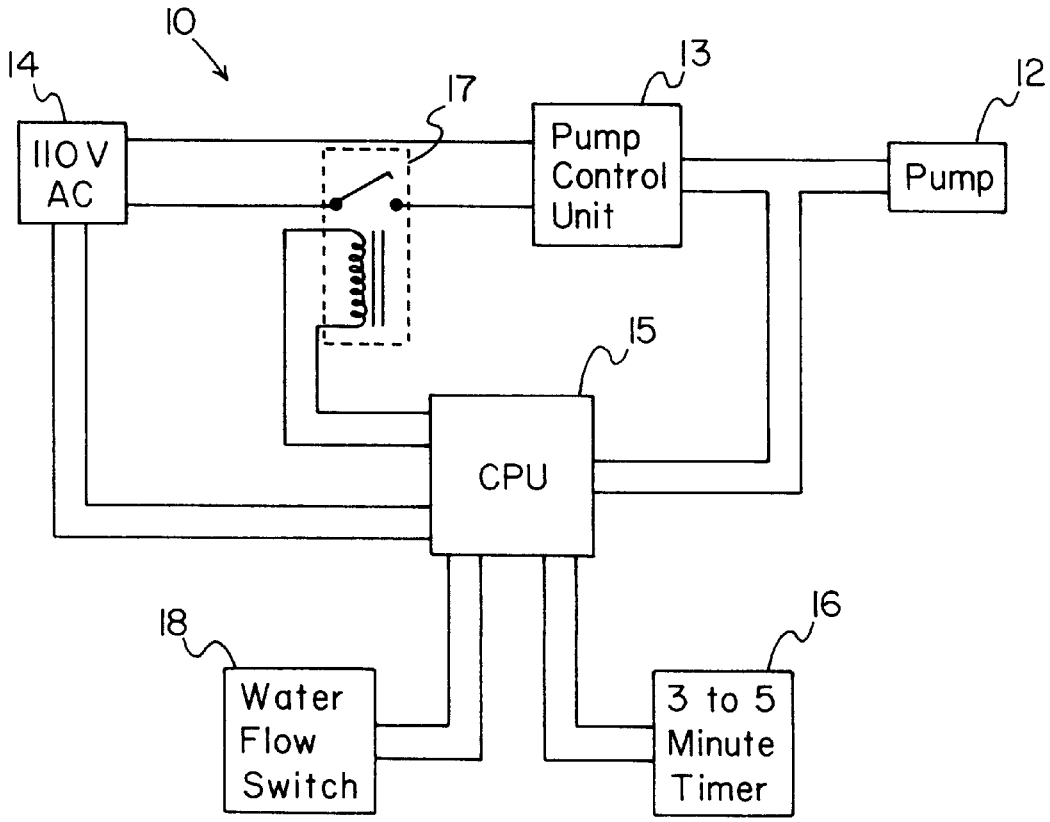
FIG. 4 is an electrical schematic of the present invention.

The processor 15 also has a flow switch 18 electrically connected thereto. The flow switch 18 has a flow sensor 19 in the outlet conduit 20. The flow sensor 19 is designed for measuring the amount of fluid flow through the outlet conduit 20. In use, the flow switch 18 is activated when the flow sensor 19 detects fluid flow through the outlet conduit 20 above a predetermined amount of fluid flow. As illustrated in FIG. 2, the flow sensor is ideally an arm which is pivotally connected to the flow switch and extends into the outlet conduit 20. In this ideal embodiment, the arm may be pivoted by fluid flowing through the outlet conduit. The flow switch is activated by the arm when the arm is pivoted beyond a predetermined angle by fluid flow.

In use, the flow switch 18 deactivates the timer 16 to prevent the timer 16 from measuring the predetermined amount of time when the flow switch 18 is activated by the flow sensor 19 when the flow sensor 19 detects fluid flow through the outlet conduit 20 above the predetermined amount of time during the predetermined amount of time measured by the timer 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A shut off system for a pump, comprising:

a pump having an inlet conduit and an outlet conduit, said pump being for pumping fluid from said inlet conduit to said outlet conduit when said pump is activated, said outlet conduit having a substantially circular lumen with a substantially uniform cross-section along the length of the outlet conduit;

said pump having a primary switch for selectively activating and deactivating said pump;

a processor being electrically connected to said primary switch;

said processor having a timer for measuring a predetermined amount of time;

said timer being activated to measure said predetermined amount of time when said primary switch activates said pump;

said processor deactivating said pump after said timer measures said predetermined amount of time;

said processor having a flow switch, said flow switch having a flow sensor in said outlet conduit, said flow sensor for measuring the fluid flow through said outlet conduit, said flow switch being activated when said flow sensor detects fluid flow through said outlet conduit above a predetermined amount, said flow sensor comprising a paddle arm extending into the lumen of the outlet and pivotally mounted such that flow through said outlet conduit pivots said paddle arm from an orientation wherein a plane of said paddle arm is oriented perpendicular to the flow direction through said outlet conduit; and said flow switch deactivating said timer to prevent said timer from measuring said predetermined amount of time when said flow switch is activated by said flow sensor when said flow sensor detects fluid flow through said outlet conduit above said predetermined amount during said predetermined amount of time.

2. The shut off system of claim 1, further comprising a power source being electrically connected to said pump, said power source providing power to activate said pump.

3. The shut off system of claim 1, wherein said predetermined amount of time is between about 3 and 5 minutes.

4. The shut of system of claim 1, wherein said processor has a relay, said relay being for selectively shutting off power to said pump, wherein said timer activates said relay to shut off power from power supply to said pump after said timer measures said predetermined amount of time.

5. A shut off system for a pump, comprising:

a pump having an inlet conduit and an outlet conduit, said pump being for pumping fluid from said inlet conduit to said outlet conduit when said pump is activated, said outlet conduit having a substantially circular lumen with a substantially uniform cross-section along the length of the outlet conduit;

a power source being electrically connected to said pump, said power source providing power to activate said pump;

said pump having a primary switch for selectively activating and deactivating said pump;

a processor being electrically connected to said primary switch;

said processor having a timer for measuring a predetermined amount of time, wherein said predetermined amount of time is between about 3 and 5 minutes;

said timer being activated to measure said predetermined amount of time when said primary switch activates said pump;

said processor having a relay, said relay being for selectively shutting off power from said power supply to said pump;

said timer activating said relay to shut off power from power supply to said pump after said timer measures said predetermined amount of time;

said processor having a flow switch, said flow switch having a flow sensor in said outlet conduit, said flow sensor for measuring the fluid flow through said outlet conduit, said flow switch being activated when said flow sensor detects fluid flow through said outlet conduit above a predetermined amount, said flow sensor comprising a paddle arm extending into the lumen of the outlet and pivotally mounted such that flow through said outlet conduit pivots said paddle arm from an orientation wherein a plane of said paddle arm is oriented perpendicular to the flow direction through said outlet conduit; and said flow switch deactivating said timer to prevent said timer from measuring said predetermined amount of time when said flow switch is activated by said flow sensor when said flow sensor detects fluid flow through said outlet conduit above said predetermined amount during said predetermined amount of time.

6. The shut off system of claim 1, wherein said paddle arm of said flow sensor has a surface area less than a quarter of a cross-sectional area of said lumen of said outlet conduit for permitting debris to pass through said outlet conduit without becoming lodged between said paddle arm and a wall of said outlet conduit and thereby plugging said outlet conduit.

7. The shut off system of claim 1, wherein said paddle arm extends downwardly into said lumen of said outlet conduit from a top portion of a wall defining said outlet conduit so that said fluid flow must extend adjacent to said top portion of said outlet conduit to pivot said paddle arm.

8. The shut off system of claim 1, wherein said paddle extends downward from a top portion of said outlet conduit such that said paddle arm does not extend below a horizontal diametric axis of said outlet conduit.

* * * * *